US005482573A

United States Patent [19]

Sakurada et al.

[11] Patent Number: 5,482,573

[45] Date of Patent: Jan. 9, 1996

[54] MAGNETIC MATERIAL

[75] Inventors: Shinya Sakurada; Takahiro Hirai, both of Yokohama; Akihiko Tsutai, Kawasaki; Masashi Sahashi, Yokohama; Hideo Nagai, Nagareyama; Tsutomu Yamashita, Yokohama, all of Japan

[73] Assignee: Kabushiki Kaisha Toshiba, Kawasaki, Japan

[21] Appl. No.: 961,821

[22] Filed: Oct. 16, 1992

[30] Foreign Application Priority Data

| | | | |
|---|---|---|---|
| Oct. 16, 1991 | [JP] | Japan | 3-266670 |
| Mar. 30, 1992 | [JP] | Japan | 4-071959 |
| Jun. 24, 1992 | [JP] | Japan | 4-165593 |

[51] Int. Cl.[6] ..... H01F 1/055

[52] U.S. Cl. ..... 148/301; 420/83; 420/125

[58] Field of Search ..... 148/301; 420/83, 420/125

[56] References Cited

U.S. PATENT DOCUMENTS

| | | | |
|---|---|---|---|
| 4,710,242 | 12/1987 | Yamagishi et al. | 148/301 |
| 5,017,247 | 5/1991 | Honkura et al. | 148/302 |
| 5,135,584 | 8/1992 | Fujiwara | 148/301 |

FOREIGN PATENT DOCUMENTS

| | | |
|---|---|---|
| 0046075 | 2/1982 | European Pat. Off. . |
| 0251233 | 1/1988 | European Pat. Off. . |
| 0369097 | 5/1990 | European Pat. Off. . |
| 0417733 | 3/1991 | European Pat. Off. . |
| 60-244003 | 12/1985 | Japan . |
| 61-10209 | 1/1986 | Japan . |
| 63-24030 | 2/1988 | Japan . |
| 1-175205 | 7/1989 | Japan . |
| 1-298704 | 12/1989 | Japan . |
| 2-192102 | 7/1990 | Japan . |
| 3-16102 | 1/1991 | Japan . |
| 3-198306 | 8/1991 | Japan . |

OTHER PUBLICATIONS

Patent Abstracts of Japan, vol. 11, No. 365 (C–460)(2812), Nov. 27, 1987, & JP–A–62–136–550 Jun. 19, 1987.

Patent Abstracts of Japan, vol. 13, No. 58 (E–714)(3406), Feb. 9, 1989, & JP–A–63–248–102, Oct. 14, 1988.

IEE Transactions on Magnetics, vol. 23, No. 5, pp.2705–2707, Sep., 1987, Y. Fukui, et al., "Effect Of Zirconium Upon Structure And Magnetic Properties Of 2–17 Type Rare Earth–Cobalt Magnets".

Patent Abstracts of Japan, vol. 13, No. 293 (C–615)(3641), Jul. 6, 1989, & JP–A–1–87–745, Mar. 31, 1989.

*Primary Examiner*—John P. Sheehan

*Attorney, Agent, or Firm*—Oblon, Spivak, McClelland, Maier & Neustadt

[57] ABSTRACT

A magnetic material with an improved maximum energy product useful for high performance permanent magnet, bond magnet and other applications is disclosed. The magnetic material is expressed in a general formula $R1_xR2_yM_{100-x-y}$ where R1 is at least one element selected from the rare earth elements, R2 is at least one element selected from elements having an atomic radius in a range of 0.156 to 0.174 nm, M is at least one element selected from Fe and Co and x and y are atomic percent individually defined as $x \geqq 2$, $y \geqq 0.01$ and $4 \leqq x+y \leqq 20$, and M occupying 90 atomic percent or more in the principal phase of the compound.

27 Claims, 7 Drawing Sheets

MAGNETIC MATERIAL

BACKGROUND OF THE INVENTION

1. Field of the Invention

This invention relates to a magnetic material and, more particularly, it relates to a magnetic material useful for permanent magnet, bond magnet or other material.

2. Description of the Related Art

As high performance rare earth permanent magnets, hitherto, Sm-Co system magnet and Nd-Fe-B system magnet are known and their mass production is currently promoted. These magnets contain Fe and Co at high concentrations and they contribute to raise the level of saturation magnetization ($B_s$). These magnets also contain rare earth elements such as Nd and Sm, and the rare earth elements bring about a very large magnetic anisotropy derived from the behavior of 4f electrons in the crystal field. As a result, the coercive force ($iH_c$) is increased, and a magnet of high performance is realized. Such high performance magnets are mainly used in electric appliances such as loudspeakers, motors and instruments.

Recently, on the other hand, there has arisen a great demand for down-sized electronic appliances and efforts have been required to provide permanent magnets of even higher performance that can be realized by improving the maximum energy product [$(BH)_{max}$] of permanent magnet.

SUMMARY OF THE INVENTION

It is an object of the present invention to provide a high performance magnetic material having an improved maximum energy product.

It is another object of the present invention to provide a magnetic material having an improved Curie temperature in the principal phase as well as an improved maximum energy product.

According to the invention, the above objects are achieved by providing a magnetic material which is expressed in a general formula:

$$R1_xR2_yM_{100-x-Y} \quad (I)$$

where R1 is at least one element selected from the rare earth elements, R2 is at least one element selected from elements having an atomic radius in a range of 0.156 to 0.174 nm, M is at least one element selected from Fe and Co and x and y are atomic percent individually defined as $x \geqq 2$, $y \geqq 0.01$ and $4 \leqq x+y \leqq 20$, and M occupying 90 atomic percent or more in the principal phase of the compound.

The atomic radius is defined in "Вокий г.в.. кристаллохимия.. м., «Наука»,1971, 400 с.с ИЛ.".

The principal phase herein denotes the phase occupying the largest volume in the crystal and amorphous phases in the compound.

FIG. 1 of the accompanying drawings illustrates a typical X-ray diffraction pattern of a magnetic material according to the present invention obtained by using Cu-Kα X-rays. As seen from FIG. 1, the diffraction angle 2θ has peak levels that appear somewhere around 30°, 37°, 43°, 45° and 49° if taken between 20° and 55°. Of the peaks, the one appearing around 45° may be attributable to the reflection of X-rays by α-Fe (or α-Fe, Co) existing in the magnetic material. All the remaining peaks are indexed in terms of $TbCu_7$ crystal structure, and can be regarded as the peak from (101) plane, the peak from (110) plane, a combination of peaks from (200), (111) and (002) plane, and the peak from (201) plane, appearing at diffraction angles in ascending order, respectively.

Now, the role that each of the component elements plays in the magnetic material expressed by the general formula (I) and the basis for defining the compounding ratio of the component elements will be described.

(1) Element R1

The element R1 which is selected from the rare earth elements may be La, Ce, Pr, Nd, Sm, Eu, Gd, Tb, Dy, Ho, Er, Tm, Yb, Lu, Y or a combination of any of these elements. The element R1 serves to remarkably improve the magnetic anisotropy of the magnetic material and provide it with large coercive force.

If the content of the element R1 is less than 2 atomic percent, α-Fe is formed to a great extent and no large coercive force can be obtained. If, on the other hand, the element R1 distributes excess amount, the saturated magnetic flux density is extremely lowered. The content of the element R1 is preferably in a range of 2 to 16 atomic percent. It is particularly preferable that sum of Sm, Er, Tm and Yb occupy more than 50 percent of the element R1 to further improve the magnetic anisotropy of the magnetic material.

(2) Element R2

The element R2 which is an element having an atomic radius in a range of 0.156 to 0.174 nm may be selected from a group consisting of Sc, Zr and Hf. The element R2 can increase the concentration of M in the principal phase by occupying part of the rare earth site of the element R1 to reduce the average atomic radius of the rare earth site. It also can accelerate the formation of the principal phase typically having a $TbCu_7$ crystal structure.

It will be explained why the atomic radius of the element R2 is set within the range specified above. Of rare earth elements, Lu has the least atomic radius, i.e., 0.174 nm. Hence, if the element R2 has an atomic radius greater than 0.174 nm, it is impossible to reduce the atomic radius of the rare earth site, and the concentration of M in the principal phase is difficult to be increased. On the other hand, if the element R2 has an atomic radius less than 0.156 nm, changes to the Fe site will more likely occur.

If the content of the element R2 is less than 0.01 atomic percent, α-Fe is formed to a great extent and no strong coercive force can be obtained. If, on the other hand, the element R1 distributes excess amount, the relative volume of the element M is lowered to remarkably reduce the saturated magnetic flux density. The content of the element R2 is preferably in a range of 0.5 to 6 atomic percent.

By defining the total amount of the elements R1 and R2 to be within a range of 4 to 20 atomic percent, it is possible to obtain a magnetic material possessing both excellent anisotropy and high coercive force. More preferably, the sum of the elements R1 and R2 is within a range of 6 to 16 atomic percent.

(3) Element M

The element M is Fe or Co or the combination of them. This element M plays a role of increasing the saturated magnetic flux density of the magnetic material. The effect of the element M becomes remarkable when it is added by equal to or more than 70 atomic percent. The element M contains Fe preferably by equal to or more than 50 percent and more preferably by equal to or more than 65 percent.

The element M may partly be replaced by an element T (where T is at least one element selected from Ti, Cr, V, Mo, W, Mn, Ni, Ga, Al, Nb and Ta) so that the ratio of the principal phase which is typically a phase having a $TbCu_7$ crystal structure to the whole magnetic compound may be increased. Moreover, the concentration of the M element in the principal phase can be raised by partly replacing the M element by the T element. However, if most part of the element M is replaced by the element T, the saturated magnetic flux density will be reduced. Therefore, it is preferable that the element T occupies 20 atomic percent or less in the element M.

A magnetic material expressed by the general formula (I) above may contain impurities such as oxides that can inevitably contaminate magnetic materials.

The concentration of the element M in the principal phase is defined as above because, if the concentration is less than 90 atomic percent, no satisfactorily high saturated magnetic flux density can be achieved for the magnetic material.

A magnetic material expressed by the general formula (I) above can be manufactured by any of the processes (1) through (5) described below.

(1) An powdery alloy is prepared by using specified amounts of the elements R1, R2 and M and adding the element T as required for partly replacing the element M and then turned into an alloy hot melt by arc melting or radio frequency melting. Thereafter, a magnetic material is produced by a single or double roll method with which the hot melt is injected into a single or double roll revolving at a high rotary speed for rapid cooling.

(2) A magnetic material is produced by a rotary disc method with which an alloy hot melt prepared in a manner as described in (1) above is injected onto a rotary disc for rapid cooling.

(3) A magnetic material is produced by a gas atomizing method with which an alloy hot melt prepared in a manner as described in (1) above is injected into inert gas such as He for rapidly cooling.

(4) A magnetic material is produced by casting an alloy hot melt prepared in a manner as described in (1) above into a die.

(5) A magnetic material is produced by either a mechanical alloying method or mechanical grinding method with which a powdered mixture prepared by using specified amounts of the elements-R1, R2 and M and adding the element T as required to partly replace the element M is subjected to mechanical energy to turn into an alloy. With any of these processes, the mixture of the component elements are turned into an alloy by solid-phase reaction. Practical methods for inducing a solid-phase reaction includes the method of applying mechanical impacts to the powdered mixture which is loaded into a planetary ball mill, rotary ball mill, attriter, vibration ball mill, screw ball mill or the like.

In the processes (1), (2) and (4) above, the rapid cooling of the alloy hot melt is preferably carried out in an atmosphere of inert gas such as Ar or He, because the magnetic material is protected against any possible degradation of its magnetic properties that may be caused by oxidation of the material when the alloy hot melt is rapidly cooled.

In the process (5) above, the powder mixture is preferably performed solid-phase reaction in an atomosphere of inert gas such as Ar or He as the same reason describe above.

If required, the magnetic material obtained by any of the above described processes (1) through (5) may be heat treated at 300° to 1,000° C. for 0.1 to 50 hours either in an atmosphere of inert gas such as Ar or He or in vacuum. With such a heat treatment, the ratio of the principal phase to the whole amount of the produced magnetic material can be increased.

The magnetic material obtained by any of the processes (1) through (4) can be crushed and ground to powder by means of a ball mill, brown mill, stamp mill or the like. Whereas the magnetic material produced by either a mechanical alloying method or mechanical grinding method with the process (5) is in a powdered state and, therefore, it does not require an additional crushing step.

Next, some methods for manufacturing a permanent or bond magnet from a powdered magnetic material according to the invention will be described.

(a) A permanent magnet is manufactured from the powdered magnetic material by forming a unified high density body (of compressed powder) of the magnetic material by hot press or hot immersion press (HIP). Here, by applying a magnetic field to the formed body to align the crystal orientation, a permanent magnet having a high magnetic flux density may be obtained. Moreover, by carrying out a plastic deformation processing on the formed body under high pressure at 300° to 700° C. after the hot press or HIP, the permanent magnet may be magnetically oriented along the axis of easy magnetization.

(b) A permanent magnet is manufactured from the powdered magnetic material by sintering the latter.

(c) A bond magnet is manufactured from the powdered magnetic material by mixing it with resin such as epoxy resin and nylon and thereafter forming a magnet body of the mixture by compression. When an epoxy resin type thermosetting resin is used, the body formed by compression is preferably cured at a temperature of 100° to 200° C. after the compression forming. When a nylon type thermoplastic resin is used, an injection molding method is preferably employed. The injection molding is also possible.

(d) a metal bond magnet is manufactured from the powdered magnetic material by mixing it with a low melting point metal or alloy and thereafter forming a magnet body of the mixture by molding. The low melting point metal may be selected from Al, Pb, Sn, Zn and Mg and an alloy of any of these metals may be used for the low melting point alloy.

According to the invention, the above objects are also achieved by providing a magnetic material which is expressed in a general formula:

$$R1_xR2_yA_zM_{100-x-y-z} \quad \text{(II)}$$

where R1 is at least one element selected from the rare earth elements, R2 is at least one element selected from elements having an atomic radius in a range of 0.156 to 0.174 nm, A is at least one element selected from H, C, N and P, M is at least one element selected from Fe and Co and x, y and z are atomic percent individually defined as $x \geqq 2$, $y \geqq 0.01$, $4 \leqq x+y \leqq 20$ and $0 \leqq z \leqq 20$, and the principal phase of the material having a $TbCu_7$ crystal structure, M occupying 90 atomic percent or more of all the elements, but A, in the principal phase of the compound.

The term "atomic radius" is defined in the Russion literature referred to previously.

The principal phase herein denotes the phase occupying the largest volume in the crystal and amorphous phases in the compound.

Now, the role that each of the component elements plays in the magnetic material expressed by the general formula (II) and the basis for defining the compounding ratio of the component elements will be described.

As for the elements R1 and R2, the description made earlier regarding the general formula (I) is also applicable here. Furthermore, the element R2 is capable of increasing the concentration of M in the phase having a $TbCu_7$ crystal structure. In particular, in the case of z being zero, Sm, Er, Tm and Yb are preferably contained in the element R1, occupying 50 atomic percent or more of the element R1. In the case of $0<z\leqq 20$, Pr, Nd, Tb and Dy are preferably contained in the element R1, occupying 50 atomic percent or more of the element R1. The magnetic anisotropy of the obtained magnetic material can be significantly improved if the element R1 has such a composition.

The earlier description on the element M for the general formula (I) is also applicable to the element M in the formula (II). The effect of the element M is remarkable when it is added to the magnetic material by equal to or more than 70 atomic percent. The Fe content of the element M is preferably equal to or more than 50 percent and more preferably it is equal to or more than 65 percent.

The element M may partly be replaced by an element T (where T is at least one element selected from Ti, Cr, V, Mo, W, Mn, Ni, Ga, Al, Nb and Ta). The effect of partly replacing the element M with the element T for a magnetic material expressed by the general formula (II) will be similar to that of replacement the element M with the element T for the general formula (I).

The element A is at least one element selected from H, C, N and P. The element A is principally located at the interstitial positions of the $TbCu_7$ crystal structure, extending the crystal lattice as compared with the case where the element A is not contained and varying the energy band structure of the electrons. As a result, the Curie temperature, saturated magnetic flux density and magnetic anisotropy of the principal phase are improved. If the content of the element A exceeds 20 atomic percent, a $TbCu_7$ phase can hardly be formed. The content of the element A is preferably 10 atomic percent or less.

A magnetic material expressed by the general formula (II) above may contain impurities such as oxides that can inevitably contaminate magnetic materials.

The concentration of the element M in the principal phase is defined as above because, if the concentration is less than 90 atomic percent, no satisfactorily high saturated magnetic flux density can be achieved for the magnetic material.

A magnetic material expressed by the general formula (II) above can be manufactured by the process as described below when at least one element selected from C and P is used for the element A.

An powdery alloy is prepared by using specified amounts of the elements R1, R2, A (C or P or the combination of these) and M and adding the element T as required to partly replace the element M and turned into a magnetic material by any of the processes (1) through (5) as described above. If required, the obtained magnetic material may be heat treated at 300° to 1,000° C. for 0.1 to 50 hours either in an atmosphere of inert gas such as Ar or He or in vacuum. With such a heat treatment, the ratio of the principal phase to the whole amount of the produced magnetic material can be increased.

A magnetic material expressed by the general formula (II) above can be manufactured by the process as described below when N or H or combination of these is used for the element A.

An powdery alloy is prepared by using specified amounts of the elements R1, R2 and M and adding the element T as required to partly replace the element M and turned into a magnetic material by any of the processes (1) through (5) as described above. The powder of magnetic material (alloy) obtained by crushing and grinding the magnetic material in a ball mill, brown mill, stamp mill or the like is heat treated at 300° to 800° C. for 0.1 to 100 hours in an atmosphere of nitrogen gas or hydrogen gas or their combination having a 0.001 to 2 atmospheric pressure to produce a desired magnetic material. Note that the crushing step can be omitted if the process of (5) is used because the magnetic material obtained by that process is in a powdery state.

A gaseous nitrogen compound such as ammonia may be used in place of nitrogen gas or hydrogen gas or their combination for the atmosphere of the above heat treatment.

The partial pressure of nitrogen or nitrogen compound or its mixture gas may be preferably set in a range of 0.001 to 2 atomospheric pressures.

In the above nitriding or hydrogenating process, it is possible to mix other gas not containing nitrogen or hydrogen, aside from nitrogen or nitrogen compound gas or hydrogen or hydrogen compound gas. When mixing oxygen, however it is desired to set partial pressure of oxygen at 0.02 atmospheric pressure or less in order to avoid deterioration of magnetic properties due to formation of oxide during heat treatment.

Nitrogen compounds such as RN (where R is R1 or R2 or the combination of these as defined above) may be used as a starting material in the above described process of preparing a powdery alloy so that a magnetic material containing nitrogen as the element A may be manufactured by solid-phase reaction.

Permanent and bond magnets can be manufactured from the powdered magnetic material by using any of the methods described earlier by referring to the general formula (I).

According to the invention, the above objects are also achieved by providing a magnetic material which is expressed in a general formula:

$$R1_xR2_yA_zO_uM_{100-x-y-z-u} \quad \text{(III)}$$

where R1 is at least one element selected from the rare earth elements, R2 is at least one element selected from elements having an atomic radius in a range of 0.156 to 0.174 nm, A is at least one element selected from H, C, N and P, M is at least one element selected from Fe and Co and x, y, z and u are atomic percent individually defined as $x\geqq 2$, $y\geqq 0$, $4\leqq x+y\leqq 20$, $0\leqq z\leqq 20$ and $u\leqq 4$, and the principal phase of the material having a $TbCu_7$ crystal structure or a $ThMn_{12}$ crystal structure.

More specifically, the present invention provides a magnetic material which is expressed by a general formula:

$$R1_xO_uM_{100-x-u} \quad \text{(III-a)}$$

where R1 is at least one element selected from the rare earth elements, M is at least one element selected from Fe an Co and x and u are atomic percent individually defined as $x\geqq 2$, and $u\leqq 4$, and the principal phase of the material having a $TbCu_7$ crystal structure or a $ThMn_{12}$ crystal structure.

The present invention also provides a magnetic material which is expressed by a general formula:

$$R1_xA_zO_uM_{100-x-z-u} \quad \text{(III-b)}$$

where R1 is at least one element selected from rare earth elements, A is at least one element selected from H, C, N and P, M is at least one element selected from Fe and Co and x, z and u are atomic percent individually defined as $x \geqq 2$, $0 \leqq z \leqq 20$ and $u \leqq 4$, and the principal phase of the material having a $TbCu_7$ crystal structure or a $ThMn_{12}$ crystal structure.

The present invention also provides a magnetic material which is expressed in a general formula:

$$R1_xR2_yO_uM_{100-x-y-u} \quad \text{(III-c)}$$

where R1 is at least one element selected from the rare earth elements, R2 is at least one element selected from elements having an atomic radius in a range of 0.156 to 0.174 nm, M is at least one element selected form Fe and Co and x, y, and u are atomic percent individually defined as $x \geqq 2$, $y>0$, $4 \leqq x+y \leqq 20$ and $u \leqq 4$, and the principal phase of the material having a $TbCu_7$ crystal structure or a $ThMn_{12}$ crystal structure.

Finally, the invention also provides a magnetic material which is expressed by a general formula:

$$R1_xR2_yA_zO_uM_{100-x-y-z-u} \quad \text{(III-d)}$$

where R1 is at least one element selected from the rare earth elements, R2 is at least one element selected from elements having an atomic radius in a range of 0.156 to 0.174 nm, A is at least one element selected from H, C, N and P, M is at least one element selected from Fe and Co and x, y, z and u are atomic percent individually defined as $x \geqq 2$, $y>0$, $4 \leqq x+y \leqq 20$, $0<z \leqq 20$ and $u \leqq 4$, and the principal phase of the material having a $TbCu_7$ crystal structure or a $ThMn_{12}$ crystal structure.

The term "atomic radius" is defined in the Russion literature referred to previously.

The principal phase herein denotes the phase occupying the largest volume in the crystal and amorphous phases in the compound.

Now, the role that each of the component elements plays in the magnetic material expressed by the general formula (II) and the basis for defining the compounding ratio of the component elements will be described.

As for the elements R1 and R2, the description made earlier regarding the general formula (I) is also applicable here. In particular, in the case of z being zero, Sm, Fe, Tm and Yb preferably contained in the element R1, occupying 50 atomic percent or more of the element R1. In the case of $0<z \leqq 20$, Pr, Nd, Tb and Dy are preferably contained in the element R1, occupying 50 atomic percent or more of the element R1. The magnetic anisotropy of the obtained magnetic material can be significantly improved if the element R1 has such a composition.

The earlier description on the element M for the general formula (I) is also applicable to the element M in the formula (III). The effect of the element M is remarkable when it is added to the magnetic material by equal to or more than 70 atomic percent. The Fe content of the element M is preferably equal to or more than 50 percent and more preferably it is equal to or more than 65 percent.

The element M may partly be replaced by an element T (where T is at least one element selected from Si, Ti, Cr, V, Mo, W, Mn, Ni, Ga, Al, Nb and Ta). The effect of partly replacing the element M with the element T for a magnetic material expressed by the general formula (III) will be similar to that of replacement the element M with the element T for the general formula (I).

The rare earth elements to be used for the element R1 as well as the element T (Fe in particular) that shows the highest degree of saturation magnetization of all the elements of the compound are easily oxidizable. Therefore, the existence of oxygen within the compound can deteriorate the purity of the R-T permanent magnet system that contains rare earth and transition elements and reduce the level of saturation magnetization and the maximum energy product of the compound. If the concentration of 0 in the compound is high, it can prevent the progress of the formation of principal phase during the solid-phase reaction and consequently degrade the magnetic properties of the magnetic material. A magnetic material having excellent magnetic properties can be obtained when the concentration of oxygen is held 4 atomic percent or less. If, on the other hand, the concentration of oxygen is held to less than 0.05 atomic percent, the produced powdery magnetic material is chemically unstable and offers difficulties in handling particularly in the atmosphere. Therefore, the concentration of oxygen in the compound is preferably 0.05 atomic percent or more.

The element A is at least one element selected from H, C, N and P. The element A is principally located at the interstitial positions of the $TbCu_7$ crystal structure, or the $ThMn_{12}$ crystal structure, extending the crystal lattice as compared with the case where the element A is not contained and varying the energy band structure of the electrons. As a result, the Curie temperature, saturated magnetic flux density and magnetic anisotropy of the principal phase are improved. If the content of the element A exceeds 20 atomic percent, a $TbCu_7$ phase can hardly be formed. The content of the element A is preferably 10 atomic percent or less.

A magnetic material expressed by any of the general formulas (III-a) and (III-c) above can typically be manufactured by the process as described below.

Firstly a powdery mixture or alloy containing specified amounts of the elements R1, R2 and M and, if required, the element T for partly replacing the element M is fed into a container. Then, the mixture or alloy is subjected to a mechanical alloying process where mechanical impacts are applied to it by means of a planetary ball mill, rotary ball mill, screw ball mill or attriter. As shown in FIG. 2, a container to be used for the above purpose normally comprises a container main body 1, a lid 3 to be secured to the main body 1 by screws 2 and an O-ring 4 to be placed between the top surface of the container main body 1 and the contact area of the lid 3 for hermetical sealing of the container. The lid 3 is normally fitted to the main body 1 in a special facility such as a dry box filled with argon or other inert gas for hermetical sealing of the container. However, when the process of mechanical alloying is conducted on a powdery mixture or alloy in a container as shown in FIG. 2, impacts are applied not only to the powder but also to the area connecting the container main body 1 and the lid 3 to inevitably degrade the airtightness of the container. As the airtightness of the container is degraded, air can penetrate into the container main body 1 so that the operation of mechanical alloying is thereafter conducted in an oxygen containing atmosphere and the oxygen concentration in the atmosphere is gradually increased to adversely affect the yield of the principal phase (having a $TbCu_7$ crystal structure).

In view of these circumstances, it is preferable to use a double lid type container as illustrated in FIG. 3 to ensure the hermetical sealing of the container. The container of FIG. 3 comprises a container main body 12 provided with an inwardly projecting annular flange 11 along the circumference of the top opening. A first lid 13 having a downward projection is fitted onto the flange 11 to abut its upper and lateral surfaces and secured to the annular flange 11 by means of a plurality of bolts 14. A first O-ring 15 is placed between the lower surface of the first lid 13 and the upper surface of the annular flange 11 to airtightly seal the container. A second lid 16 is placed on the top of the container main body 12 and secured to it by means of a plurality of bolts 17. A second O-ring 18 is placed between the top surface of the main body 12 and the lower surface of the second lid 16 to improve the airtight sealing of the container. It may be easily understood that such a double lid type container may not be necessary if the entire operation of applying impacts to the powdery mixture or alloy is carried out in a room filled with inert gas or in a vacuum room.

If the inside of the container is held under an inert condition by using inert gas, it is recommended that the purity of inert gas is strictly controlled so that typically the total concentration of oxygen and that of moisture are held to less than 4 atomic percent.

For the purpose of the present invention, it is also recommended that powdery rare earth elements and iron to be used for preparing a powdery mixture or alloy are handled in an inert gas atmosphere to avoid any possible oxidation of the elements.

The duration of the operation of mechanical alloying to be conducted for the purpose of the present invention is preferably in a range of 0.5 to 1,000 hours. The reason for this is that, if the operation is terminated within 0.5 hours, the reaction of producing the magnetic material does not advance satisfactorily, whereas, if it is carried on for more than 1,000 hours, not only the component elements are significantly oxidized but also the manufacturing cost can be considerably raised.

If required, the powdery magnetic material (alloy) obtained in an above described manner may be heat treated at 300° to 1,000° C. for 0.1 to 50 hours either in an atmosphere of inert gas such as Ar or He or in vacuum. With such a heat treatment, the ratio of the principal phase having a $TbCu_7$ crystal structure to the whole amount of the produced magnetic material can be increased.

A magnetic material expressed by the general formulas (III-b) and (III-d) above can be manufactured by a method similar to those described earlier with regard to the general formulas (III-a) and (III-c) for processing an alloy containing specified amounts of the elements R1, R2 and M and, if required, the element T for partly replacing the element M when at least one element selected from C and P is used for the element A.

A magnetic material expressed by the general formulas (III-b) and (III-d) above can be manufactured by heat treating a powdery alloy obtained by a method similar to those described with regard to the general formulas (III-a) and (III-c) at 300° to 800° C. for 0.1 to 100 hours in an atmosphere of nitrogen or hydroger or their combination having a 0.001 to 2 atmospheric pressure. Nitrogen compounds such as RN (where R is R1 or R2 or the combination of these as defined above) may be used as a starting material in the above described process of preparing a powdery alloy so that a magnetic material expressed by the general formulas (III-b) and (III-d) and containing nitrogen as the element A may be manufactured by solid-phase reaction.

Permanent and bond magnets can be manufactured from the powdered magnetic material by using any of the methods described earlier by referring to the general formula (I).

In the magnetic material of the invention, represented by the formula (I), i.e., $[\mathbf{R1}_x\mathbf{R2}_yM_{100-x-y}]$, the element M (Fe, Co, a combination of these) occupies 90 atomic percent or more of the principal phase. Hence, the material is remarkably improved in its saturation magnetization. Further, since R1 is a rare earth element, the magnetic material has great magnetic anisotropy and is, therefore, improved in maximum energy product $[(BH)_{max}]$.

Thanks to the element M (Fe, Co, or a combination of these) occupying 90 atomic percent or more of the principal phase, the magnetic material has great magnetic anisotropy and and improved maximum energy product $[(BH)_{max}]$, though the principle phase is indexed in terms of $TbCu_7$ crystal structure.

More specifically, the lattice constants a and c of a hexagonal crystal can be evaluated when the principal phase is indexed in terms of $TbCu_7$ crystal structure. Examples of crystal structures having a crystal structure that resembles the crystal structure of a magnetic material according to the present invention include the $Th_2Zn_{17}$ crystal structure and the $ThMn_{12}$ crystal structure. The lattice constants a and c of the $Th_2Zn_{17}$ crystal structure and the $ThMn_{12}$ crystal structure can be transformed to that of the $TbCu_7$ crystal structure by using the formulas below.

$a(TbCu_7)=c(ThMn_{12})$ $c(TbCu_7)=a(ThMn_{12})/2$ $a(TbCu_7)=[a(Th_2Zn_{17})]/(3^{1/2})$ $c(TbCu_7)=c(Th_2Zn_{17})/3$

Thus, the ratio of lattice constants can be expressed as $c(TbCu_7)/a(TbCu_7)$ [hereinafter referred to as c/a] in terms of the $(TbCu_7)$ crystal structure. So the above cited known magnetic materials are expressed as follows by using the ratio c/a.

$Th_2Zn_{17}$ crystal structure . . . c/a:about 0.84

$ThMn_{12}$ crystal structure . . . c/a:about 0.88

The value of the ratio of lattice constants c/a is closely related to the concentration of M (Fe or Co or the combination of these) in the phase in question. If the composition of the principal phase is expressed by $R_1M_w$ (where R represents the aggregate of the elements R1 and R2 and M represents Fe or Co or the combination of these) and the $Th_2Zn_{17}$ and $ThMn_{12}$ crystal structures are respectively defined by formulas (1) and (2) below, then relationship between c/a and w can be expressed by formula (3).

$$c/a\text{: about } 0.84 \rightarrow w = 8.5 \quad (1)$$

$$c/a\text{: about } 0.88 \rightarrow w = 12 \quad (2)$$

$$\left.\begin{aligned} w &= (5+2d)/(1-d), \\ d &= (25/6)\times(c/a)-(19/6) \end{aligned}\right] \quad (3)$$

From the formula for the composition of the principal phase and the formula (3) above, it may be clear that the larger the value of c/a, the greater the value w, and the higher the concentration of the element M in the composition. As a result, the magnetic material is improved in saturated magnetic flux density. It will be possible to realize a crystal structure having a large value of c/a by replacing to a large extent the element M by the element T ((where T is at least one element selected from Si, Ti, Al, Ga, V, Ta, Mo, Nb, Cr, W, Mn and Ni). It should be noted, however, that the value of c/a is not the single determinant of the level of the saturated magnetic flux density because the replacing elements can reduce the saturated magnetic flux density to a certain extent.

On the other hand, it may be noted that a magnetic material whose principal phase has a $Th_2Zn_{17}$ crystal structure shows a relatively small value of approximately 0.84 for the ratio c/a. The concentration of M in the principal phase having such a crystal structure is approximately 89 atomic percent, meaning that the level of its saturated magnetic flux density is not sufficiently high.

A magnetic material according to the invention is characterized in that it can have a phase having a large c/a value ($c/a \geqq 0.845$) by partly replacing the element R1 representing one or more than one rare earth elements by the element R2 representing Sc, Zr and/or Hf in order to reduce the atomic radius of the atoms located in the sites of the rare earth elements. Since the concentration level of the element M in the principal phase is high enough in the large c/a value, a magnetic material having a large saturation magnetization can be obtained by utilizing the above-mentioned phase as principle phase.

In the magnetic material of the invention, which is represented by the formula (II), i.e., $[R1_xR2_yA_zM_{100-x-y-z}]$, the element A is used as an interstitial element, the principal phase has a $TbCu_7$ crystal structure, and the element M occupies 90 atomic percent or more of the total amount of all elements, but A, in the principal phase. Thereby, the material is remarkably improved in the Curie temperature of the principal phase, saturation magnetization and magnetic anisotropy.

According to the invention, generation of an impurity phase of Fe, Co or Fe Co alloy is suppressed in a magnetic material expressed by the general formula (III) $[R1_xR2_yA_zO_uM_{100-x-y-z-u}]$ by partly replacing the element R1 representing one or more than one rare earth elements with the element R2 representing Sc, Zr and/or Hf. Generation of oxides can also be suppressed by limiting the concentration of O (oxygen) below 4 atomic percent. A magnetic material obtained by such an arrangement has highly pure phases, the principal phase of which possesses a $TbCu_7$ crystal structure or a $ThMn_{12}$ crystal structure, and a high maximum energy product $[(BH)_{max}]$. Besides, the use of costly rare earth elements can be significantly reduced to lower the overall cost of manufacturing the magnetic material by using the M elements (Fe, Co) as a constituent and partly replacing the rare earth elements with the element R1 representing Sc or Zr or Hf.

According to the invention, the Curie temperature, saturation magnetization and magnetic anisotropy of a magnetic material expressed by the general formula (III) $[R1_xR2_yA_zO_uM_{100-x-y-z-u}]$ are still further improved by introducing the element A as an interstitial element.

A magnetic material according to the present invention and expressed by the general formula (I), (II) or (III) is useful as a material of permanent magnet and bond magnet having a high maximum energy product $[(BH)_{max}]$.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
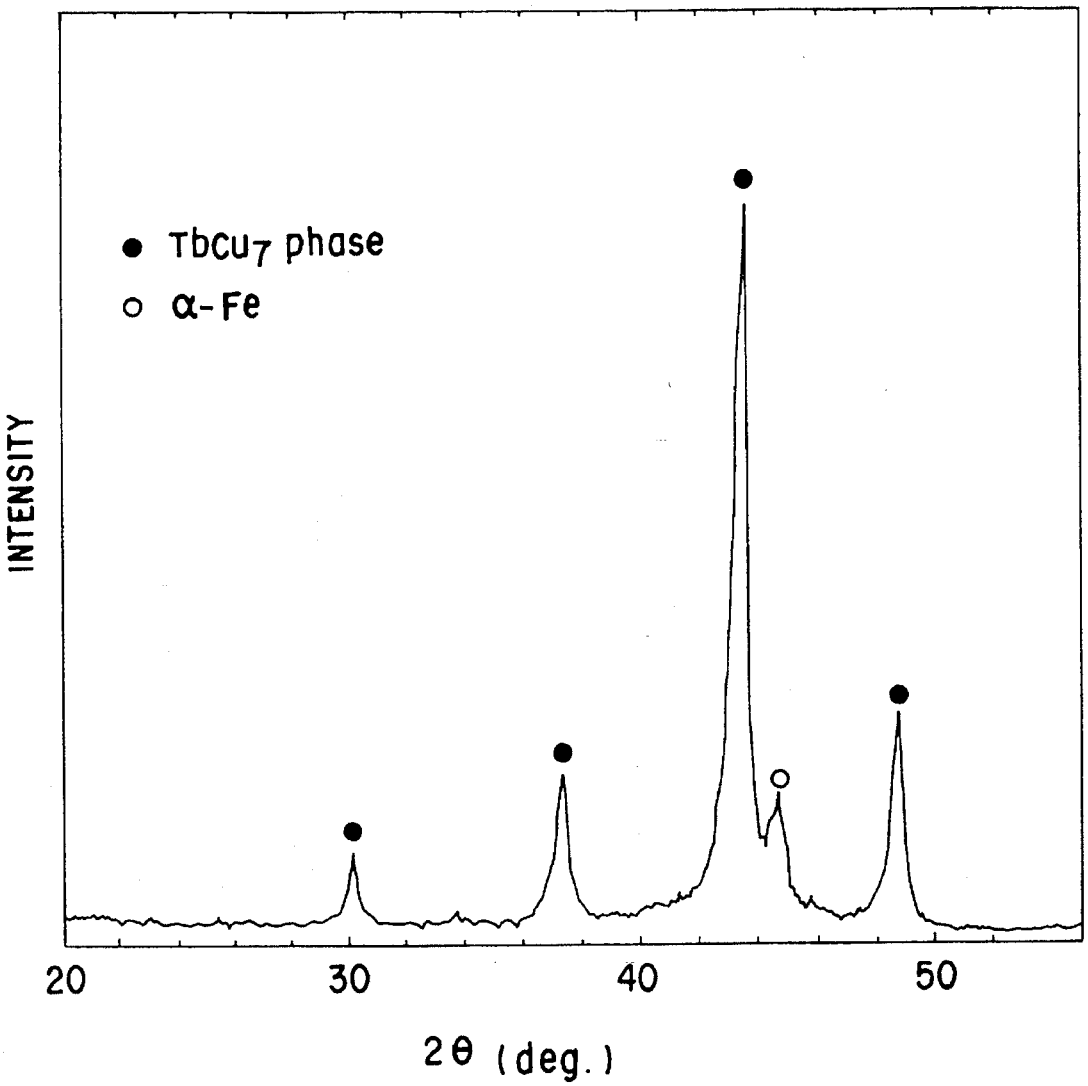
FIG. 1 is a graph showing a typical X-ray diffraction pattern (using CuKα radiation) of a magnetic material with a principal phase having a $TbCu_7$ crystal structure according to the invention.
Figure 2:
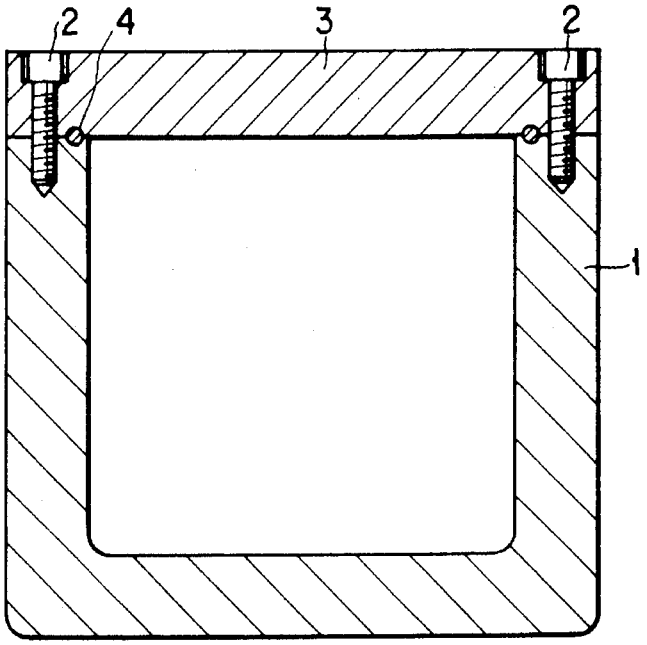
PRIOR ART FIG. 2
FIG. 2 is a sectional view of a conventional container to be used for mechanical alloying.

Now, the present invention will be described in greater detail by way of preferred embodiments. Embodiments 1 to 10

High pure powdery Nd, Sm, Pr, Y, Sc, Zr, Hf, V, Ti, Cr, Mn, Ni, Mo, Al, Fe and Co were blended at atomic fractions as listed in Table 1 below to obtain ten different mixtures. The mixtures were separately melted by arc in an Ar atmosphere and the melted mixtures were poured into respective molds to obtain ingots. The alloy ingots were again melted separately for the respective embodiments and alloy ribbons were prepared therefrom by using a single roll method where the melted alloy of each alloy ingot was injected onto a copper roll having a diameter of 300 mm in argon atmosphere using a surface velocity of 40 m/sec. Each of the obtained alloy ribbons was subsequently heat treated for 60 minutes at a temperature as shown in Table 1 below and crushed to alloy powder (magnetic material) having an average particle diameter of 60 μm.

Then epoxy resin was added to each specimen of alloy powder by 2 weight percent. The mixtures were compression molded under a pressure of 8 ton/cm$^2$ and then cured at 150° C. for 2.5 hours to produce six specimens of bond magnet.

Controls 1 and 2

Firstly, two different mixtures having compositions as listed in Table 1 were prepared from high pure powdery Nd, Sm, Zr, Hf, Ti, Al, Cr, Fe and Co. The mixtures were separately melted by arc in an Ar atmosphere and the melted mixtures were poured into respective molds to obtain ingots. Alloy ribbons were prepared therefrom in a manner as described for Embodiments 1 to 10 and each of the obtained alloy ribbons was subsequently heat treated at 700° C. for 60 minutes and then crushed to alloy powder (magnetic material) having an average particle diameter of 60 μm. Then epoxy resin was added to each specimen of alloy powder by 2 weight percent. The mixtures were compression molded under a pressure of 8 ton/cm$^2$ and then cured at 150° C. for 2.5 hours.

The obtained magnet specimens of Embodiments 1 to 10 and Controls 1 and 2 were tested for residual magnetization, coercive force and maximum energy product. The results of the test are also shown in Table 1 below. In Table 1, the results of measurement of the total amount of M (Co or Fe or the combination of these) and T (V, Ti, Cr, Mn, Ni, Mo, Ga or Al or a combination of any of these) in the principal phase of each of the powdery alloys of Embodiments 1 to 10 and the alloy ribbons of Controls 1 and 2 by TEM (Transmission Electron Microscopy) are also listed. Note that the related figures for Embodiments 1 and 2 are respective atomic percents of M in the principal phase, whereas the corresponding figures for Embodiments 3 to 10 and Controls 1 and 2 are respective atomic percents of M and T in the principal phase.

TABLE 1

| Embodiment | Composition (bal denotes balance) | Heat treatment temperature (°C.) | Total amount of M & T in the principal phase (atm %) | Residual magnetization (kG) | Coercive force (kOe) | Maximum energy product (MGOe) |
|---|---|---|---|---|---|---|
| 1 | $Nd_1Sm_6Pr_1Zr_4Hf_4Fe_{bal}$ | 600 | 91.6 | 5.8 | 7.8 | 5.9 |
| 2 | $Nd_4Sm_5Y_1Zr_2Fe_{bal}$ | 600 | 91.5 | 6.0 | 6.8 | 6.2 |
| 3 | $Sm_7Pr_1Zr_2V_5Mo_2Fe_{bal}$ | 600 | 90.9 | 5.6 | 8.1 | 5.5 |
| 4 | $Sm_4Zr_2Hf_1Ti_5Co_2Fe_{bal}$ | 600 | 91.8 | 5.9 | 6.2 | 5.7 |
| 5 | $Sm_4Zr_1Ti_2Ga_3Co_1Fe_{Bal}$ | 600 | 92.2 | 6.1 | 6.0 | 6.3 |
| 6 | $Sm_6Nd_2Hf_1V_3Al_2Fe_{bal}$ | 500 | 90.4 | 5.2 | 5.8 | 5.2 |
| 7 | $Sm_7Sc_{0.2}Zr_{2.8}V_1Fe_{bal}$ | 600 | 90.6 | 5.8 | 4.8 | 5.7 |
| 8 | $Sm_5Zr_1Hf_1MN_1Fe_{bal}$ | 700 | 92.1 | 5.9 | 4.6 | 5.6 |
| 9 | $Sm_2Nd_2Pr_1Zr_3Cr_2Co_5Fe_{bal}$ | 700 | 92.5 | 5.6 | 2.4 | 4.1 |
| 10 | $Sm_6Pr_2Zr_3Ni_2Co_{12}Fe_{bal}$ | 700 | 90.8 | 5.6 | 4.6 | 5.8 |
| Control | | | | | | |
| 1 | $Sm_9Nd_3Zr_8Hf_9Ti_3Al_5Fe_{bal}$ | 700 | 85.5 | 3.2 | 6.3 | 1.7 |
| 2 | $Sm_2Cr_1Fe_{bal}$ | 700 | 90.8 | 1.8 | 0.5 | 0.4 |

As apparent from Table 1 above, the magnet specimens of Embodiments 1 to 10 have excellent magnetic properties. When compared with them, the specimen of Control 1 has a poor residual magnetization because of an insufficient iron concentration in the principal phase. The specimen of Control 2 has a conspicuously reduced coercive force because of an increase in the volume of the soft magnetic phase of α-Fe and other iron ingredients due to an excessively high iron concentration in the magnet specimen.

Embodiment 11

High pure powdery Nd, Zr and Fe were blended at atomic fractions as listed in Table 2 below to obtain a mixture thereof. The mixture was melted by arc in an Ar atmosphere to produce an alloy ingot. A 20 to 50 g of the alloy ingot was filled in a vertical quartz tube having a bore with an inner diameter of 0.8 mm at the bottom and heated by high frequency induction heating in an Ar atmosphere. Subsequently, Ar gas was supplied to the upper portion of the quartz tube under a pressure of approximately 300 torr to inject the melted alloy from the bottom of the quartz tube onto a copper roll rotating at a surface velocity of 40 m/s and produce an alloy ribbon by rapid quenching.

The obtained alloy ribbons was subsequently heat treated in vacuum at 600° C. for 24 hours and thereafter crushed in a ball mill filled with ethanol.

The powdered alloy was then filled in a metal mold and heat treated at 450° C. for 2 hours in a nitrogen atmosphere under the atmospheric pressure to obtain a specimen of magnet.

Embodiments 12 to 17

Six different specimens of magnet were prepared from respective mixtures of ingredients and atomic fractions as listed in Table 2 in a manner same as that of preparation of Embodiment 11.

Figure 4:
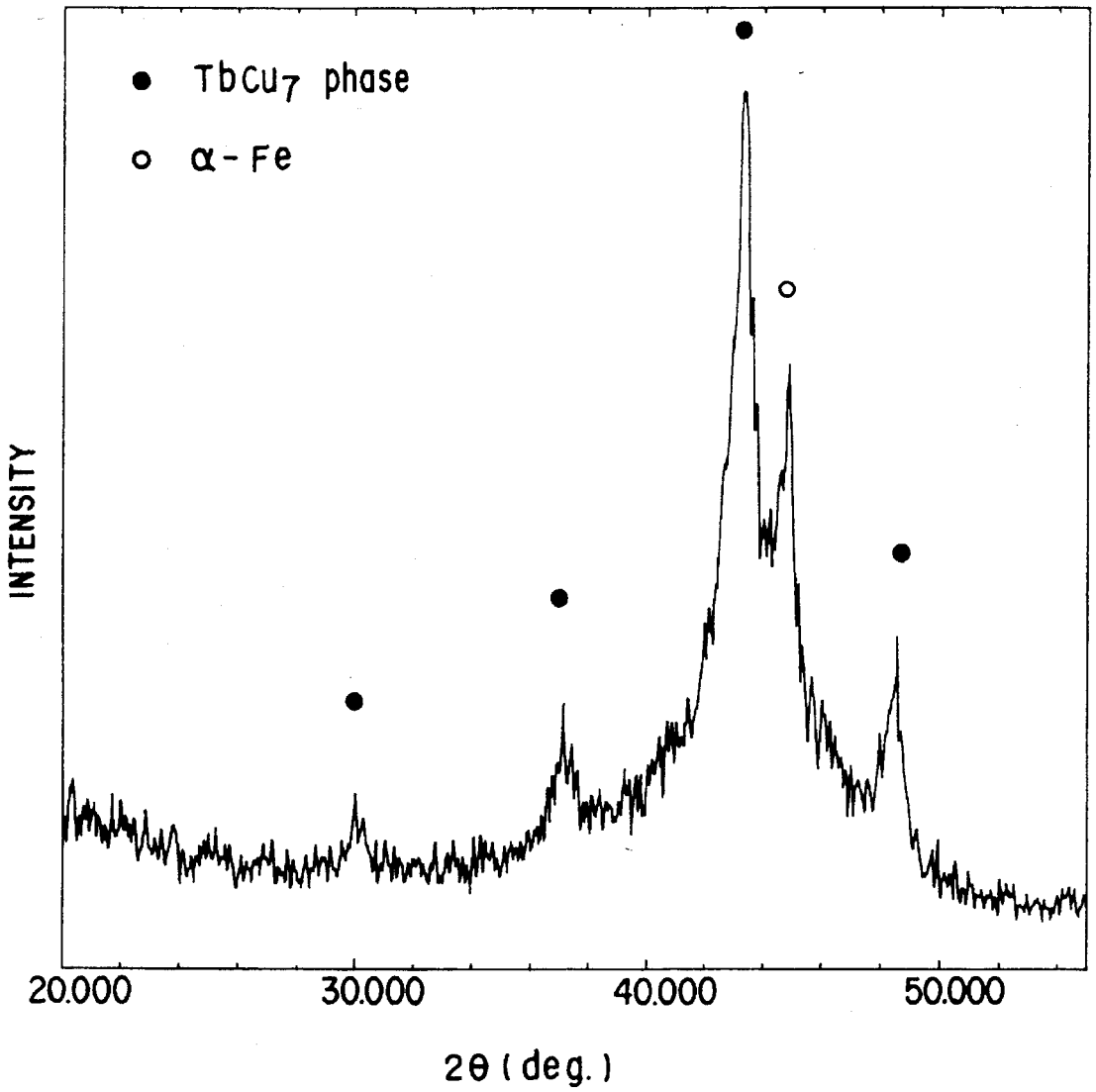
FIG. 4 is a graph showing the X-ray diffraction pattern obtained by using the alloy ribbon of Embodiment 11 as described below.
Figure 5:
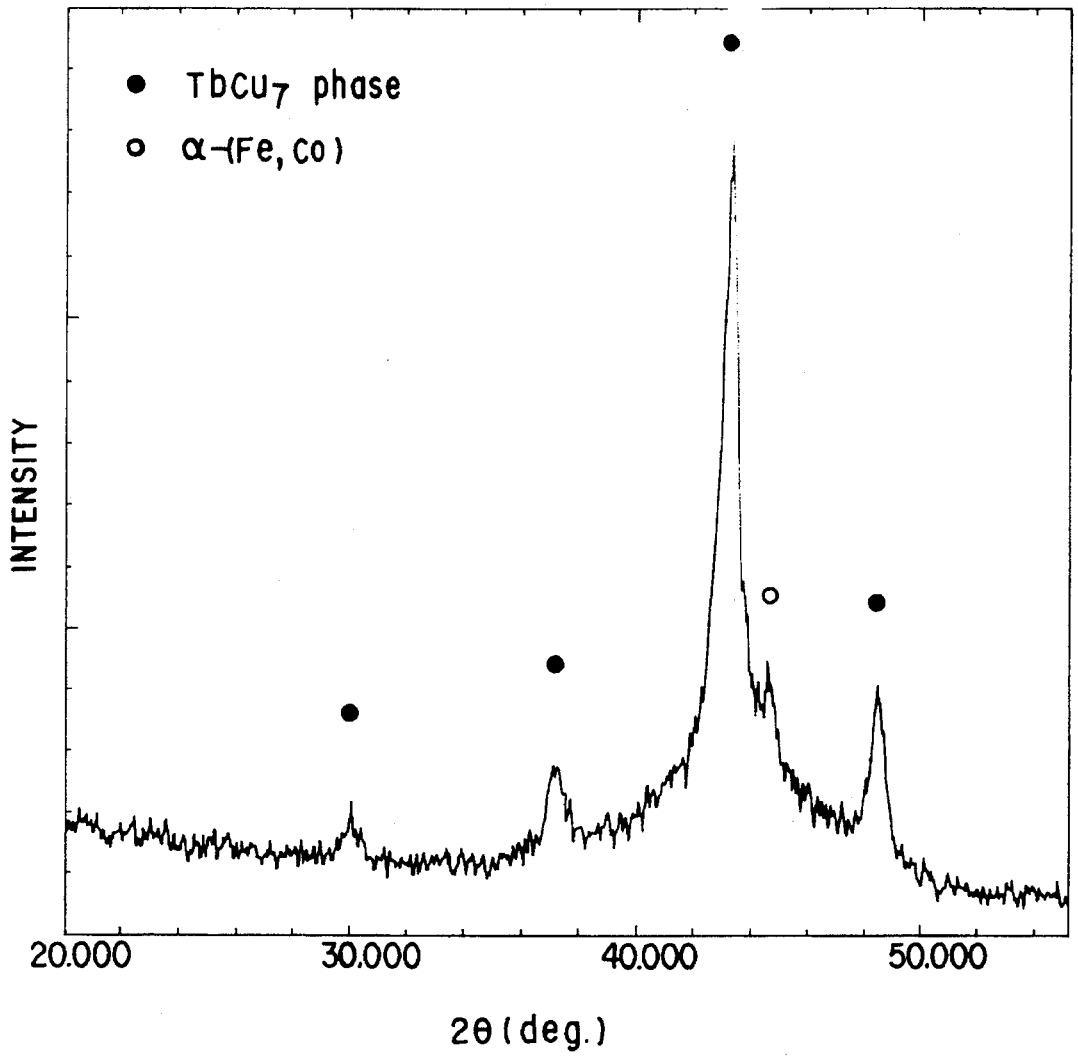
FIG. 5 is a graph showing the X-ray diffraction pattern obtained by using the alloy ribbon of embodiment 12 as described below.

The alloy ribbons of Embodiments 11 and 12 were analyzed to determine their crystal structures and lattice constants by means of X-ray diffraction using CuKα radiation. As a result, they showed X-ray diffraction patterns as illustrated respectively in FIGS. 4 and 5. When tested, each of the alloy ribbons of Embodiments 13 to 17 showed an X-ray diffraction pattern similar to those of FIGS. 4 and 5.

All the obtained X-ray diffraction patterns were indexed in terms of $TbCu_7$ crystal structure as described earlier to evaluate the lattice constants a and c. The ratio of the lattice constants $c(TbCu_7)/a(TbCu_7)[c/a]$ in terms of transformed $TbCu_7$ was determined for each of Embodiments 11 to 17 and then the value of w representing the concentration of M (Co or Fe or the combination of these) in the principal phase was calculated for each of the specimens by using the ratio c/a and the formula (3) described earlier. The obtained values are also listed in Table 2 below.

TABLE 2

| Embodiment | Composition (bal denotes balance) | c/a | w |
|---|---|---|---|
| 11 | $Nd_5Zr_4Fe_{bal}$ | 0.8729 | 11.2 |
| 12 | $Nd_5Zr_4Co_{18}Fe_{bal}$ | 0.8667 | 10.6 |
| 13 | $Nd_3Pr_4Zr_3Fe_{bal}$ | 0.8705 | 11.0 |
| 14 | $Nd_5Sm_1Zr_2Hf_1Fe_{bal}$ | 0.8715 | 11.1 |
| 15 | $Nd_3Pr_3Dy_1Zr_3Co_{20}Fe_{bal}$ | 0.8654 | 10.5 |
| 16 | $Nd_4Pr_3Tb_1Zr_2Co_{19}Fe_{bal}$ | 0.8672 | 10.7 |
| 17 | $Nd_4Zr_4Ti_2Co_{19}Fe_{bal}$ | 0.8730 | 11.2 |

Embodiments 18 to 23

High pure powdery Pr, Nd, Sm, Tb, Dy, Zr, Hf, Ti, V, W, C, Fe and Co were blended at atomic fractions as listed in Table 3 below to obtain four different mixtures, which were then separately melted by arc in an Ar atmosphere and the melted mixtures were poured into respective molds to obtain respective ingots. Subsequently, the ingots were melted and four alloy ribbons were prepared by using a rapid quenching technique where each of the melted ingots was injected onto a copper roll having a diameter of 300 mm and rotating at a surface velocity of 30 m/sec in an Ar atmosphere.

Then, each of the obtained alloy ribbons was crushed in a mortar to small particles having an average particle diameter of 50 to 100 μm and thereafter further crushed in an ethanol containing ball mill for 30 minutes. The obtained powdery alloys were heat treated at respective temperatures as listed in Table 3 below for 2 hours in an nitrogen atmosphere under the atmospheric pressure. Epoxy resin was added to each specimen of alloy powder by 2 weight percent. The mixtures were compression molded under a pressure of 8 ton/cm$^2$ and then cured at 150° C. for 2.5 hours.

The obtained specimens of magnet of Embodiments 18 to 23 were tested for residual magnetization, coercive force and maximum energy product. The results of the test are also shown in Table 3 below. In Table 3, the results of measurement of the total amount of M (Co or Fe or the combination of these) and T (Ti or W or the combination of these) in the principal phase of each of the specimens by TEM (Transmission Electron Microscopy) are also listed.

TABLE 3

| Embodiment | Composition (bal denotes balance) | Heat treatment temperature (°C.) | Total amount of M & T in the principal phase (atm %) | Residual magnetization (kG) | Coercive force (kOe) | Maximum energy product (MGOe) |
|---|---|---|---|---|---|---|
| 18 | $Nd_6Zr_3Hf_1N_8Fe_{bal}$ | 470 | 90.8 | 6.2 | 7.0 | 6.2 |
| 19 | $Nd_4Pr_2Zr_2W_1C_2N_6Fe_{bal}$ | 470 | 91.0 | 6.3 | 6.9 | 6.1 |
| 20 | $Pr_2Nd_3La_1Dy_1Zr_2N_8Co_{10}Fe_{bal}$ | 470 | 91.3 | 5.9 | 7.2 | 5.8 |
| 21 | $Pr_2Nd_2Ce_1Sm_2Tb_1Zr_2N_9Fe_{bal}$ | 470 | 90.9 | 5.9 | 6.9 | 5.7 |
| 22 | $Nd_5Sm_2Zr_2V_1N_8Co_{11}Fe_{bal}$ | 525 | 90.8 | 5.9 | 6.8 | 6.1 |
| 23 | $Nd_4Sm_1Tb_1Zr_2Ti_1N_9Fe_{bal}$ | 530 | 90.2 | 5.5 | 5.8 | 5.8 |

After the heat treatment of the powdery alloys of Embodiments 18 to 23 in a nitrogen atmosphere, they were analyzed for crystal structure by means of X-ray diffraction. As a result, it was proved that all the powdery alloys of Embodiments 18 to 23 have a principal phase having a $TbCu_7$ crystal structure.

Control 3

A mixture having a composition of $Nd_1Sm_1Zr_1Fe_{bal}$ was prepared, using high pure powdery Nd, Sm and Fe. The mixture was melted by arc in an Ar atmosphere and the melted mixture as poured into a mold to produce an ingot of the mixture. Subsequently, an alloy ribbon was prepared from the ingot by using a rapid quenching technique as in the case of Embodiments 18 to 23 and the obtained ribbon was crushed to granules having an average particle diameter of 50 to 100 μm, which were then heat treated at 540° C. for 2 hours in a nitrogen atmosphere under the atmospheric pressure. Epoxy resin was added to each specimen of alloy powder by 2 weight percent. The mixtures were compression molded under a pressure of 8 ton/cm$^2$ and then cured at 150° C. for 2.5 hours.

The obtained bond magnet of Control 3 was tested for residual magnetization, coercive force and maximum energy product to prove that it had a residual magnetization of 0.2 kG and a coercive force of 0.3 kOe. The poorly low coercive force of the bond magnet of Control 3 is attributable to an increase in the volume of the soft magnetic phase of α-Fe and other iron ingredients due to an excessively high iron concentration in the magnet specimen. Consequently, the maximum energy product was also poorly low.

Embodiment 24

Figure 3:
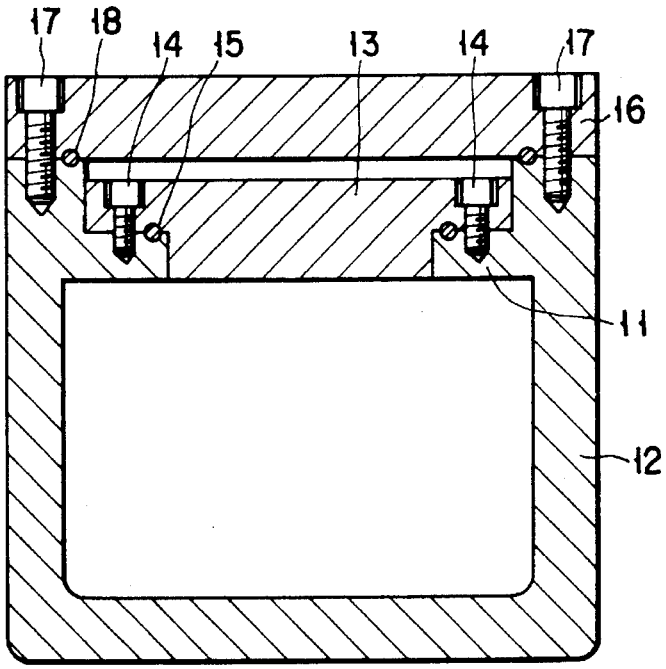
FIG. 3 is a sectional view of a container having a double lid structure that can be used for mechanical alloying for manufacturing a magnetic material according to the invention.

A mixture of high pure powdery Sm and Fe was prepared with a ratio of 12 atomic percent of Sm to 88 atomic percent of Fe. The mixture was then put in the main body 12 of a container having a double lid structure as illustrated FIG. 3 with stainless steel balls (not shown) and the remaining space of the container was filled with Ar gas whose oxygen and moisture concentrations were respectively controlled under 1 ppm and 0.5 ppm. Then, the first lid 13 was fitted to the main body 12 with the first O-ring 15 arranged there between and was secured to the main body 12 by means of the bolts 14. Thereafter, the second lid 16 was fitted to the main body 12 with the second O-ring 18 placed therebetween and was secured likewise to the main body 12 by means of the bolts 17. Subsequently, the container was loaded in a planetary ball mill for a mechanical alloying process where the mill was rotated at a rate of 200 rpm for 60 hours. After the mechanical alloying, the obtained powder was taken out of the container and heat treated at 700° C. in vacuum for 1 hour to produce a powdery alloy (magnetic material).

Control 4

A powdery alloy was prepared from Sm and Fe by mechanical alloying and heat treatment in a manner same as that of preparation of Embodiment 24 except that the container of the double lid structure was filled with Ar gas whose oxygen and moisture concentrations were not controlled.

The powdery alloys of Embodiment 24 and Control 4 were analyzed for X-ray diffraction pattern. As a result, the X-ray diffraction patterns of FIGS. 6 and 7 were obtained respectively for the powdery alloys. It was proved that the oxygen concentration of the powdery alloy of Embodiment 24 and that of the powdery alloy of Control 4 were respectively 2.5 atomic percent and 4.3 atomic percent.

Figure 6:
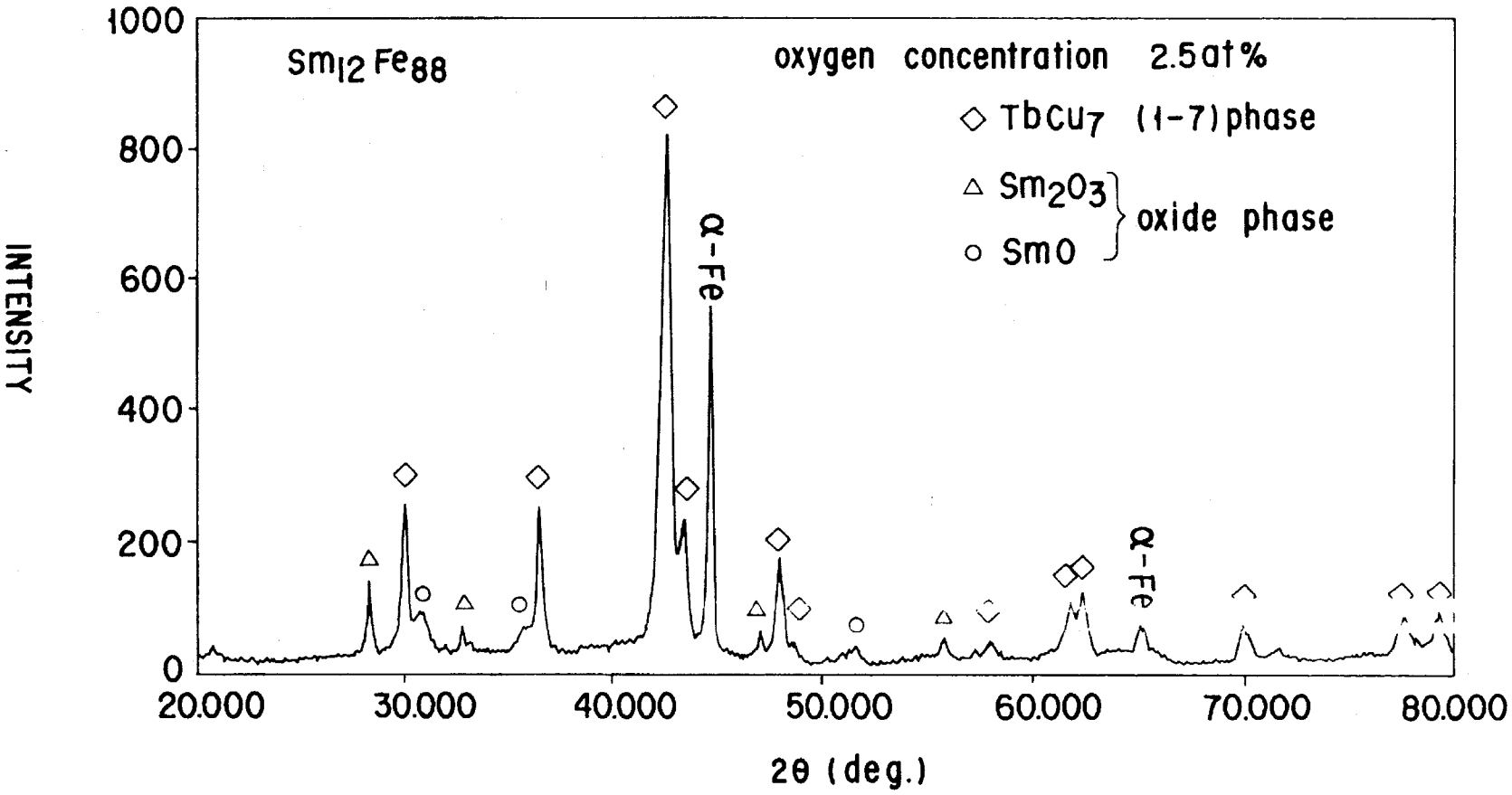
FIG. 6 is a graph showing the X-ray diffraction pattern obtained by using the alloy ribbon of Embodiment 24 as described below.
Figure 7:
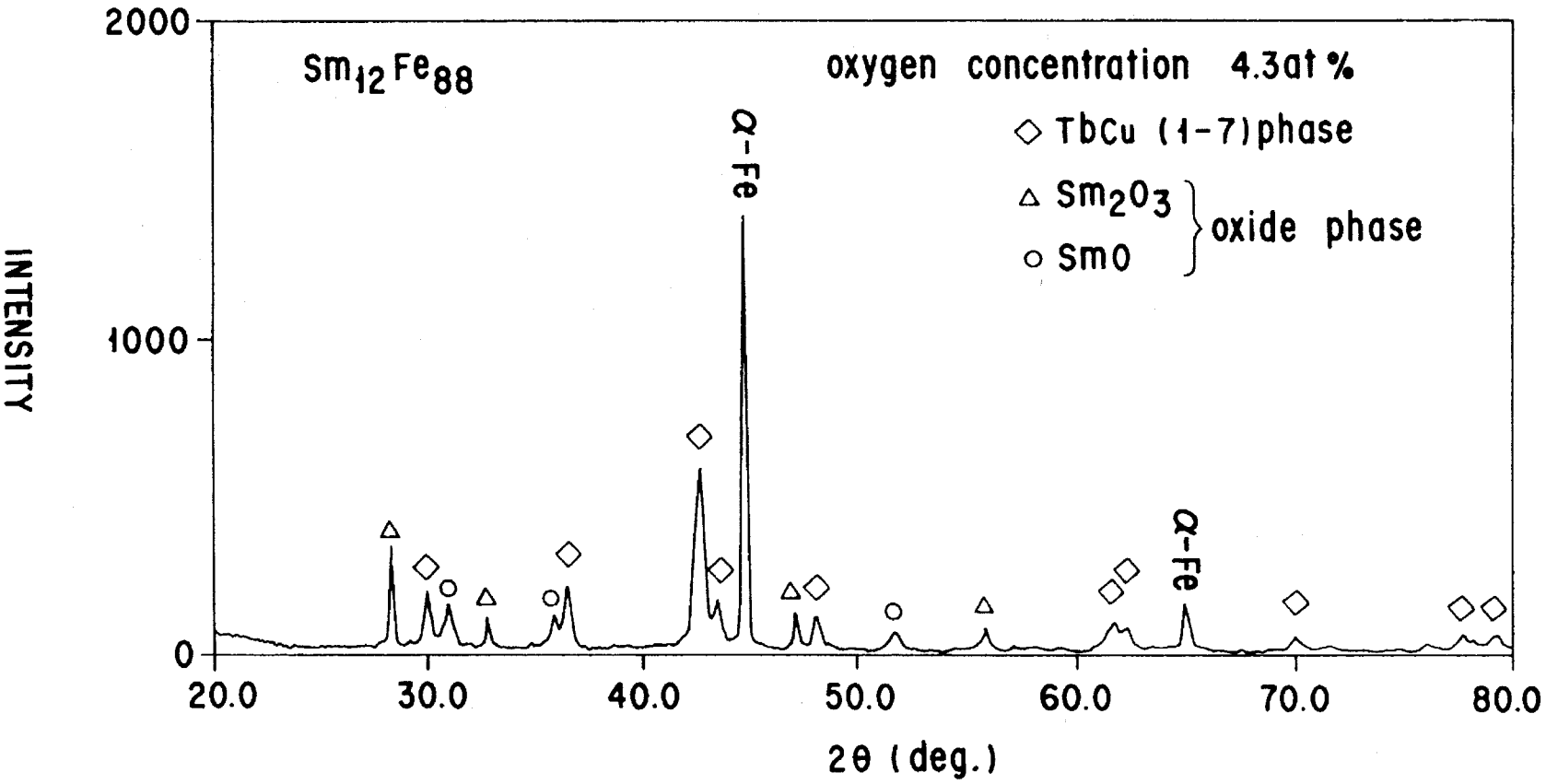
FIG. 7 is a graph showing the X-ray diffraction pattern obtained by using the powdery alloy of Control 4 as described below.

As apparent from FIG. 6, the principal phase of the powdery alloy of Embodiment 24 was a $TbCu_7$ compound phase and, therefore, the generation of oxide phases was remarkably suppressed. To the contrary, as shown in FIG. 7, the oxide phase of the powdery alloy showed very high peak values, revealing that the rare earth elements in the alloy had been selectively oxidized and some of Fe that was supposed to have been taken into the compound phase actually remained unaffected so that, consequently, the α-Fe phase had high peak values.

Embodiment 25

A powdery alloy was obtained in a manner same as that of preparation of Embodiment 28 except that a process of mechanical alloying was conducted for 20 hours in a container having a double lid structure.

Figure 8:
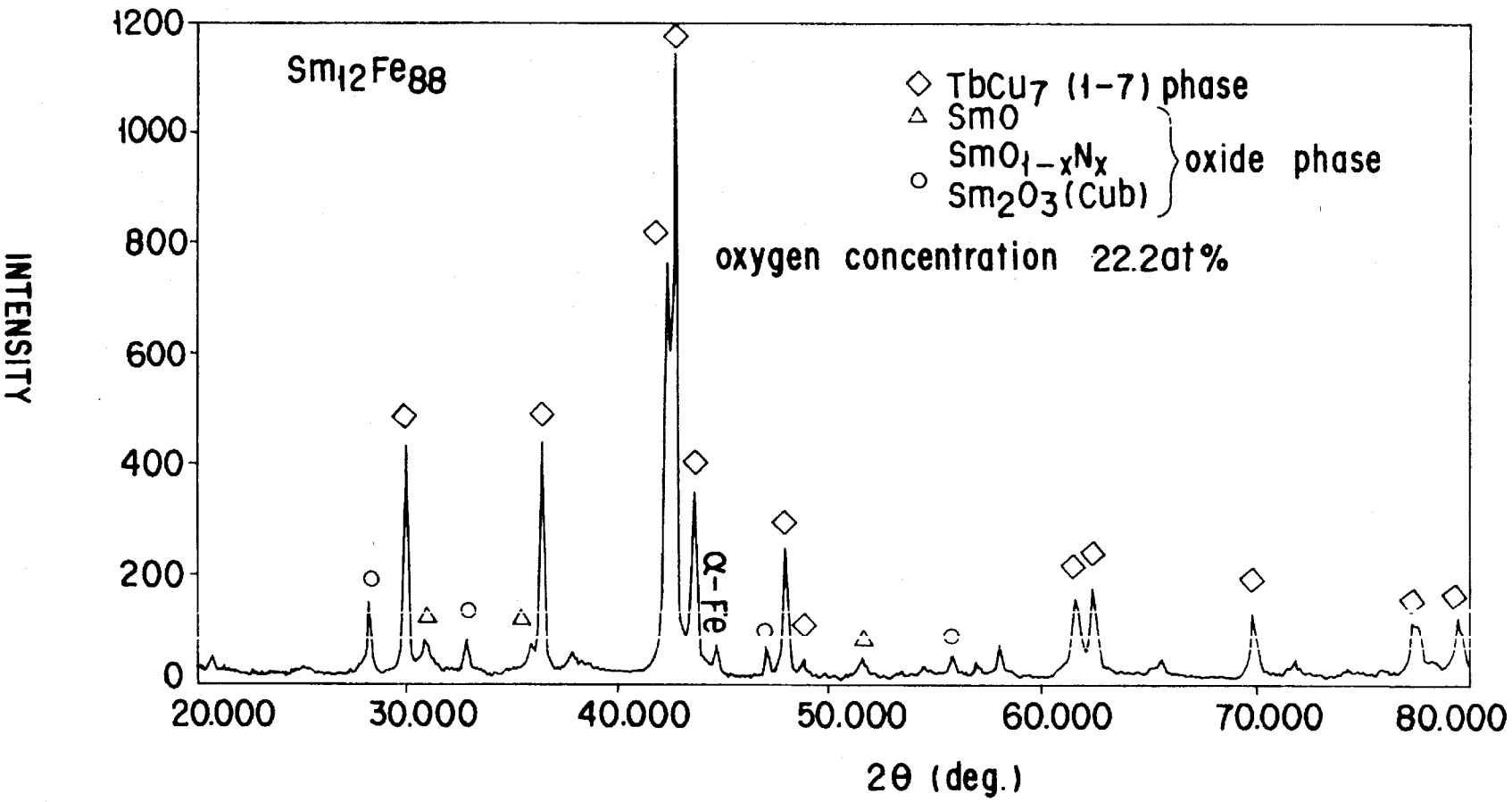
FIG. 8 is a graph showing the X-ray diffraction pattern obtained by using the powdery alloy of Embodiment 25 as described below.

The obtained powdery alloy was analyzed for X-ray diffraction pattern to obtain an x-ray diffraction pattern as illustrated in FIG. 8. As apparent from FIG. 8, the generation of oxide phases was further suppressed and the peak values of the undesired a-Fe phase were very low. The oxygen concentration of the powdery alloy was 2.2 atomic percent. As the contamination by oxygen proceeds with the operation of mechanical alloying using balls, an alloy having a desired composition can be obtained by reducing the time of operation of mechanical alloying as much as possible.

Embodiments 26 to 40

High pure powdery Sm, Nd, Pr, Gd, Zr, Hf, Fe, Co, Si, Ti, Al, Ga, V, Ta, Mo, Nb, Cr, W, Mn and Ni were blended at atomic fractions as listed in Table 4 below to obtain fifteen different mixtures. Each of the obtained mixtures was then put in the main body 12 of a container having a double lid structure as illustrated FIG. 3 with stainless steel balls (not shown) and the remaining space of the container was filled with Ar gas whose oxygen and moisture concentrations were respectively controlled under 1 ppm and 0.5 ppm. Then, the first lid 13 was fitted to the main body 12 with the first O-ring 15 arranged there between and was secured to the main body 12 by means of the bolts 14. Thereafter, the second lid 16 was fitted to the main body 12 with the second O-ring 18 placed therebetween and was secured likewise to the main body 12 by means of the bolts 17. Subsequently, the container was loaded in a planetary ball mill for a mechanical alloying process where the mill was rotated at a rate of 200 rpm for 60 hours. After the mechanical alloying, the obtained powder was taken out of the container and heat treated at 700° C. in vacuum for 1 hour to produce a powdery alloy. By applying the same process, a total of fifteen different specimens of powdery alloy were prepared.

Controls 5 to 7

Three different powdery alloys were prepared from respective mixtures having compositions as listed in Table 5 below in a manner same as that of preparation of Embodiments 30 to 40 except that the container of the double lid structure was filled with Ar gas whose oxygen and moisture concentrations were not controlled.

The powdery alloys of Embodiments 26 to 40 and Controls 5 to 7 were analyzed for X-ray diffraction pattern to determine the peak intensity ratios of the phases of the alloys. The results obtained for Embodiments 26 to 40 and those obtained for Controls 5 to 7 are respectively shown in Tables 4 and 5 below. Note that Tables 4 and 5 also show respectively the results of analysis obtained for the powdery alloys of Embodiments 24 and 25 and those for the powdery alloy of Control 4. Also note that each of the intensity ratios of the intermetallic compounds of Tables 4 and 5 is the intensity ratio of $TbCu_7$ phase or $ThMn_{12}$ phase, or the intensity ratio of the aggregate of all these phases. Here, the intensity ratio of oxides is defined as the intensity ratio of the aggregate of all the oxides involved. Therefore, the intensity ratio of oxides for Embodiment 24 means the intensity ratio of the aggregate of SmO and $Sm_2O_3$.

TABLE 4

| Embodiment | Composition | Peak intensity ratio(%) Intermetallic compound | α-Fe | Oxide |
|---|---|---|---|---|
| 24 | $(Sm_{12}Fe_{88})_{0.975}O_{2.5}$ | 43 | 40 | 17 |
| 25 | $(Sm_{12}Fe_{88})_{0.978}O_{2.2}$ | 79 | 5 | 16 |
| 26 | $(Sm_8Fe_{90}Al_1Ga_1)_{0.979}O_{2.1}$ | 80 | 6 | 14 |

TABLE 4-continued

| Embodiment | Composition | Peak intensity ratio(%) Intermetallic compound | α-Fe | Oxide |
|---|---|---|---|---|
| 27 | $(Sm_8Fe_{84}Si_8)_{0.977}O_{2.3}$ | 78 | 8 | 14 |
| 28 | $(Nd_2Zr_6Fe_{88}Ti_4)_{0.98}O_{2.0}$ | 81 | 6 | 13 |
| 29 | $(Nd_4Hf_4Fe_{78}Si_{14})_{0.973}O_{2.7}$ | 53 | 30 | 17 |
| 30 | $(Nd_6Pr_2Fe_{85}V_7)_{0.975}O_{2.5}$ | 67 | 16 | 17 |
| 31 | $(Sm_7Fe_{90}Cr_2Ni_1)_{0.974}O_{2.6}$ | 56 | 27 | 17 |
| 32 | $(Nd_5Zr_5Fe_{62}Mn_{28})_{0.977}O_{2.3}$ | 78 | 8 | 14 |
| 33 | $(Sm_{10}Fe_{78}Mo_6Nb_6)_{0.979}O_{2.4}$ | 68 | 15 | 17 |
| 34 | $(Sm_9Fe_{79}Si_8W_4)_{0.977}O_{2.3}$ | 79 | 7 | 14 |
| 35 | $(Gd_4Sm_4Fe_{85}Si_7)_{0.977}O_{2.3}$ | 77 | 8 | 15 |
| 36 | $(Nd_6Zr_2Fe_{80}C_8C_4)_{0.978}O_{2.2}$ | 79 | 7 | 14 |
| 37 | $(Nd_6Hf_2Fe_{84}P_8)_{0.975}O_{2.5}$ | 56 | 27 | 17 |
| 38 | $(Sm_7Fe_{78}Si_8N_7)_{0.979}O_{1.9}$ | 87 | 5 | 8 |
| 39 | $(Nd_4Zr_4Fe_{79}Si_5N_8)_{0.979}O_{2.1}$ | 81 | 7 | 12 |
| 40 | $(Sm_8Fe_{84}N_8)_{0.982}O_{1.8}$ | 90 | 4 | 6 |

TABLE 5

| Control | Composition | Peak intensity ratio(%) Intermetallic compound | α-Fe | Oxide |
|---|---|---|---|---|
| 4 | $(Sm_{12}Fe_{88})_{0.957}O_{4.3}$ | 20 | 58 | 22 |
| 5 | $(Sm_8Fe_{90}Al_1Ga_1)_{0.949}O_{5.1}$ | 16 | 60 | 24 |
| 6 | $(Sm_8Fe_{84}Si_8)_{0.957}O_{4.3}$ | 21 | 58 | 21 |
| 7 | $(Nd_2Zr_6Fe_{88}Ti_4)_{0.955}O_{4.5}$ | 19 | 58 | 23 |

As apparent from Table 4, the principal phase of each of the powdery alloys of Embodiments 24 to 40 contained intermetallic compounds to a large extent and the generation of oxide phases was remarkably suppressed. To the contrary, the powdery alloys of Controls 4 to 7 exhibited a high oxygen concentration and contained oxides to a large extent so that a large amount of α-Fe was deposited as shown in Table 5.

Embodiments 41 to 44

High pure powdery Sm, Nd, Zr, Fe, Co and Mo were blended at atomic fractions as listed in Table 6 below in a manner same as that of preparation of Embodiment 26 to 40.

The powdery alloys of Embodiment 41 to 44 were analyzed for X-ray diffraction pattern to determine the crystal structure of the principal phase and the peak intensity ratios of the phases of the alloys. As a result, it was provided that the powdery alloys of Embodiment 41 and 42 have a principal phase having a $TbCu_7$ crystal structure and the powder alloys of Embodiment 43 and 44 have a principal phase having a $ThMn_{12}$ crystal structure.

The peak intensity rations of the the phases of the alloys of Embodiment 41 to 44 are shown in Table 6. The powdery alloys of Embodiment 41 to 44 were tested for residual magnetization, coercive force and maximum energy product. The results of the test are also shown in Table 6.

TABLE 6

| Embodiment | Composition | Peak intensity ratio (%) Intermetallic compound | α-Fe | Oxide | Residual magnetization (kG) | Coercive force (kOe) | Maximum energy product (MGOe) |
|---|---|---|---|---|---|---|---|
| 41 | $Sm_{10}Fe_{78}N_{10}O_2$ | 91 | 5 | 4 | 6.5 | 5.5 | 5.8 |
| 42 | $Sm_{10}Fe_{70}Co_8N_{10}O_2$ | 92 | 4 | 4 | 6.7 | 5.3 | 6.0 |
| 43 | $Nd_{11}Fe_{71}Mo_6N_{10}O_2$ | 88 | 9 | 3 | 6.2 | 6.0 | 6.2 |
| 44 | $Nd_7Zr_4Fe_{74}Mo_4N_9O2$ | 88 | 10 | 2 | 6.5 | 6.1 | 6.0 |

As is apparent from the above description, the present invention provide a magnetic material with an improved maximum energy product useful permanent magnet, bond magnet and other similar applications.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A magnetic material expressed in a general formula:

$$R1_xR2_yM_{100-x-y} \quad \text{(I)}$$

where R1 is at least one element selected from the rare earth elements, R2 is at least one element selected from elements having an atomic radius in a range of 0.156 to 0.174 nm, M is at least one element selected from Fe and Co and x and y are atomic percent individually defined as $x \geqq 2$, $y \geqq 0.01$ and $4 \leqq x+y \leqq 20$, the principal phase of the material having a $TbCu_7$ crystal structure and M occupying 90 atomic percent or more in the principal phase of the compound.

2. A magnetic material according to claim 1, wherein R2 in said general formula (I) is at least one element selected from a group of Sc, Zr and Hf.

3. A magnetic material according to claim 1, wherein x in said general formula (I) is defined by $2 \leqq x \leqq 16$.

4. A magnetic material according to claim 1, wherein y in said general formula (I) is defined by $0.5 \leqq y \leqq 6$.

5. A magnetic material according to claim 1, wherein M in said general formula (I) contains Fe by equal to or more than 50 percent.

6. A magnetic material according to claim 1, wherein M in said general formula (I) is partly replaced by T (wherein T is at least one element selected from a group of Ti, Cr, V, Mo, W, Mn, Ni, Ga, Al, Nb and Ta).

7. A magnetic material according to claim 6, wherein M is partly replaced by T by 20 atomic percent or less of the total amount of M.

8. A magnetic material expressed in a general formula:

$$R1_xR2_yA_zM_{100-x-y-z} \quad \text{(II)}$$

where R1 is at least one element selected from the rare earth elements, R2 is at least one element selected from elements having an atomic radius in a range of 0.156 to 0.174 nm, A is at least one element selected from H, C, N and P, M is at least one element selected from Fe and Co and x, y and z are atomic percent individually defined as $x \geqq 2$, $y \geqq 0.01$, $4 \leqq x+y \leqq 20$ and $0<2 \leqq 20$, the principal phase of the material having a $TbCu_7$ crystal structure, and M occupying 90 atomic percent or more of all the elements but A, in the principal phase of the compound.

9. A magnetic material according to claim 8, wherein R2 in said general formula (II) is at least one element selected from a group of Sc, Zr and Hf.

10. A magnetic material according to claim 8, wherein x in said general formula (II) is defined by $2 \leqq x \leqq 16$.

11. A magnetic material according to claim 8, wherein y in said general formula (II) is defined by $0.5 \leqq y \leqq 6$.

12. A magnetic material according to claim 8, wherein z in said general formula (II) is defined by $z \leqq 10$.

13. A magnetic material according to claim 8, wherein said magnetic material contains M in said general formula (II) by equal to or more than 70 atomic percent.

14. A magnetic material according to claim 8, wherein M in said general formula (II) contains Fe by equal to or more than 50 percent.

15. A magnetic material according to claim 8, wherein M in said general formula (II) is partly replaced by T (wherein T is at least one element selected from a group of Ti, Cr, V, Mo, W, Mn, Ni, Ga, Al, Nb and Ta).

16. A magnetic material according to claim 15, wherein M is partly replaced by T by equal to or less than 20 atomic percent of the total amount of M.

17. A magnetic material which is expressed by a general formula:

$$R1_xR2_yA_zO_uM_{100-x-y-z-u} \quad \text{(III)}$$

where R1 is at least one element selected from the rare earth elements, R2 is at least one element selected from elements having an atomic radius in a range of 0.156 to 0.174 nm, A is at least one element selected from H, C, N and P, M is at least one element selected from Fe and Co and x, y, z and u are atomic percent individually defined as $x \geqq 2$, $y \geqq 0$, $4 \leqq x+y \leqq 20$, $O \leqq z \leqq 20$ and $u \leqq 4$, and the principal phase of the material having a $TbCu_7$ crystal structure.

18. A magnetic material according to claim 17, wherein R2 in said general formula (III) is at least one element selected from a group of Sc, Zr and Hf.

19. A magnetic material according to claim 17, wherein x in said general formula (III) is defined by $2 \leqq x \leqq 16$.

20. A magnetic material according to claim 17, wherein y in said general formula (III) is defined by $0<y \leqq 20$.

21. A magnetic material according to claim 17, wherein z in said general formula (III) is defined by $0<z \leqq 20$.

22. A magnetic material according to claim 17, wherein z in said general formula (III) is defined by $z \leqq 10$.

23. A magnetic material according to claim 17, wherein u in said general formula (III) is defined by $0.05 \leqq u \leqq 4$.

24. A magnetic material according to claim 17, wherein said magnetic material contains M in said general formula (III) by 70 atomic percent or more.

25. A magnetic material according to claim 17, wherein M in said general formula (III) contains Fe by equal to or more than 50 percent.

26. A magnetic material according to claim 17, wherein M in said general formula (III) is partly replaced by T (wherein T is at least one element selected from a group of Ti, Cr, V, Mo, W, Mn, Ni, Ga, Al, Nb and Ta).

27. A magnetic material according to claim 26, wherein M is partly replaced by T by equal to or less than 20 atomic percent of the total amount of M.

* * * * *